US011276537B2

(12) United States Patent
Harimochi et al.

(10) Patent No.: US 11,276,537 B2
(45) Date of Patent: Mar. 15, 2022

(54) RELAY

(71) Applicant: OMRON Corporation, Kyoto (JP)

(72) Inventors: Hiroyuki Harimochi, Kumamoto (JP); Ryota Minowa, Yamaga (JP); Naoki Kawaguchi, Yame (JP); Shinichi Ogawa, Kikuchi (JP); Kohei Otsuka, Omuta (JP); Hiroyuki Iwasaka, Kumamoto (JP); Kazuhiro Tsutsui, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 61 days.

(21) Appl. No.: 17/012,067

(22) Filed: Sep. 4, 2020

(65) Prior Publication Data

US 2021/0082648 A1 Mar. 18, 2021

(30) Foreign Application Priority Data

Sep. 18, 2019 (JP) ..... JP2019-169239

(51) Int. Cl.
*H01H 9/02* (2006.01)
*H01H 50/04* (2006.01)
*H01H 50/14* (2006.01)

(52) U.S. Cl.
CPC ..... *H01H 50/047* (2013.01); *H01H 50/14* (2013.01); *H01H 2205/002* (2013.01)

(58) Field of Classification Search
CPC ..... H01H 50/047; H01H 50/14; H01H 2205/002; H01H 45/04; H01H 47/22
USPC ..... 335/202
See application file for complete search history.

(56) References Cited

U.S. PATENT DOCUMENTS

2002/0023768 A1* 2/2002 Takami ..... H01H 50/02 174/59
2005/0179510 A1* 8/2005 Iima ..... H01H 50/14 335/126
2011/0032059 A1* 2/2011 Ito ..... H01H 50/14 335/202
2015/0187527 A1* 7/2015 Kubono ..... H01H 50/021 361/206
2016/0254113 A1* 9/2016 Nishimura ..... H01H 50/02 335/202

(Continued)

FOREIGN PATENT DOCUMENTS

JP 2016-201286 A 12/2016

*Primary Examiner* — Shawki S Ismail
*Assistant Examiner* — Lisa N Homza
(74) *Attorney, Agent, or Firm* — Shinjyu Global IP

(57) ABSTRACT

A housing includes a first mounting portion having a first through hole penetrating in a first direction and a second mounting portion having a second through hole penetrating in the first direction. The second mounting portion is disposed separately from the first mounting portion to one side in a second direction and is disposed closer to one side in a third direction than the first mounting portion. The first fixed terminal includes a first fastening portion that is exposed outside the housing closer to one side in the third direction than the first mounting portion. The second fixed terminal includes a second fastening portion that is exposed outside the housing closer to an opposite side in the third direction than the second mounting portion and that is disposed closer to the opposite side in the third direction than the first fastening portion.

7 Claims, 6 Drawing Sheets

(56) References Cited

U.S. PATENT DOCUMENTS

| | | | | |
|---|---|---|---|---|
| 2016/0300676 | A1 | 10/2016 | Sakai et al. | |
| 2019/0013171 | A1* | 1/2019 | Minowa | H01H 50/546 |
| 2019/0131093 | A1* | 5/2019 | Minowa | H01H 50/14 |
| 2019/0131094 | A1* | 5/2019 | Minowa | H01H 50/14 |
| 2019/0131095 | A1* | 5/2019 | Minowa | H01H 50/443 |
| 2019/0131096 | A1* | 5/2019 | Minowa | H01H 50/641 |
| 2019/0131097 | A1* | 5/2019 | Minowa | H01H 50/546 |
| 2019/0148095 | A1* | 5/2019 | Minowa | H01H 50/54 335/185 |
| 2019/0304727 | A1* | 10/2019 | Minowa | H01H 50/58 |
| 2019/0304729 | A1* | 10/2019 | Minowa | H01H 50/58 |
| 2019/0311871 | A1* | 10/2019 | Minowa | H01H 50/546 |
| 2019/0355536 | A1* | 11/2019 | Ozaki | H01H 9/443 |
| 2021/0375569 | A1* | 12/2021 | Ozaki | H01H 1/54 |

* cited by examiner

RELAY

CROSS-REFERENCE TO RELATED APPLICATION

This application claims priority to Japanese Patent Application No. 2019-169239, filed Sep. 18, 2019. The contents of that application are incorporated by reference herein in their entirety.

FIELD

The present invention relates to a relay.

BACKGROUND

Conventionally, an electromagnetic relay that opens and closes an electric circuit is known. The electromagnetic relay described in Japanese Laid-Open Patent Publication No. 2016-201286 includes a fixed terminal connected to an external terminal. The fixed terminal is arranged so as to protrude from a housing to the outside. The housing is provided with a mounting portion that is fixed to another member by a fixing member such as a screw.

SUMMARY

In recent years, miniaturization of relays has been required. In the conventional relay, the mounting portion is formed so as to protrude from the housing in order to secure a tool clearance. Therefore, the size of the relay becomes large in a direction in which the mounting portion protrudes.

An object of the present invention is to provide a relay capable of downsizing while securing a tool clearance when fixing a mounting portion of the relay to another member.

A relay according to one aspect of the present invention includes a housing, a first fixed terminal, and a second fixed terminal. The housing includes a first mounting portion and a second mounting portion. The first mounting portion has a first through hole penetrating in a first direction. The second mounting portion having a second through hole penetrating in the first direction. The second mounting portion is disposed separately from the first mounting portion to one side in a second direction orthogonal to the first direction and disposed closer to one side in a third direction than the first mounting portion. The third direction is orthogonal to the first direction and the second direction. The first fixed terminal includes a first fastening portion. The first fastening portion has a first screw insertion hole along the first direction and is exposed outside the housing closer to an opposite side in the third direction than the second mounting portion. The second fixed terminal includes a second fastening portion. The second fastening portion has a second screw insertion hole along the first direction and is exposed outside the housing closer to an opposite side in the third direction than the second mounting portion. The second fastening portion is disposed closer to the opposite side in the third direction than the first fastening portion. The housing includes a first side portion disposed at an opposite side in the second direction, a second side portion disposed at the one side in the second direction, a third side portion connected to the first side portion and the second side portion at the one side in the third direction, and a fourth side portion connected to the first side portion and the second side portion at the opposite side in the third direction. The first fastening portion is arranged without protruding beyond a boundary between the first side portion and the third side portion to the one side in the third direction at a height position of the first fastening in the first direction. The second fastening portion is arranged without protruding beyond a boundary between the second side portion and the fourth side portion at a height position of the second fastening portion in the first direction.

In this relay, the second fastening portion is disposed closer to the opposite side in the third direction than the second mounting portion and the first fastening portion. That is, the first fastening portion and the second fastening portion are arranged zigzag in the second direction. Accordingly, even when the first mounting portion is disposed at the one side in the third direction and the second mounting portion is disposed at the opposite side in the third direction as compared with the case where the first fastening portion and the second fastening portion are arranged side by side in the second direction, a tool clearance for fixing the first mounting portion and second fastening portion to another member can be secured. As a result, the housing can be downsized in the third direction. Further, in the case where the first fixed terminal and the second fixed terminal are plate-shaped terminals, even when widths of the first fixed terminal and the second fixed terminal are expanded in the third direction in order to improve a current carrying capacity of the relay, the housing can be downsized in the third direction while ensuring the tool clearance.

Further, since a space around the boundary between the first side portion near the first fastening portion and the third side portion is less likely to interfere with the first fastening portion, the space around the boundary between the first side portion and the third side portion can be effectively utilized. Similarly, since a space around the boundary the second side portion near the second fastening portion and the fourth side portion is less likely to interfere with the second fastening portion, the space around the boundary between the second side portion and the fourth side portion can be effectively utilized.

The first fastening portion may be disposed closer to the opposite side in the third direction than the third side portion. The second fastening portion may be disposed closer to the one side in the third direction than the fourth side portion. In this case, the space around the boundary between the first side portion and the third side portion and the space around the boundary between the second side portion and the fourth side portion can be effectively utilized.

The first fixed terminal and the second fixed terminal may be plate-shaped terminals. The first fastening portion may protrude from the first side portion. The second fastening portion may protrude from the second side portion. In this case, when using the plate-shaped fixed terminal, the housing can be downsized in the third direction while ensuring the tool clearance.

A virtual line connecting the first screw insertion hole and the second screw insertion hole may be inclined with respect to the third side portion and the fourth side portion as viewed from the first direction. In this case, the housing can be downsized in the third direction while ensuring the tool clearance.

The relay may further include a movable contact piece extending in the housing in the second direction and configured to contact the first fixed terminal and the second fixed terminal. A virtual line connecting the first screw insertion hole and the second screw insertion hole may be inclined with respect to the movable contact piece as viewed from the first direction. In this case, the housing can be downsized in the third direction while ensuring the tool clearance.

The relay may further include a connector connecting portion that is arranged to be exposed from the housing to the one side or the opposite side in the second direction. The connector connecting portion may be visible from between the first mounting portion and the first fastening portion or between the second mounting portion and the second fastening portion as viewed from the first direction. In this case, in the relay in which the connector can be visible from the first direction, the housing can be downsized in the third direction while ensuring the tool clearance.

DETAILED DESCRIPTION

Figure 3:
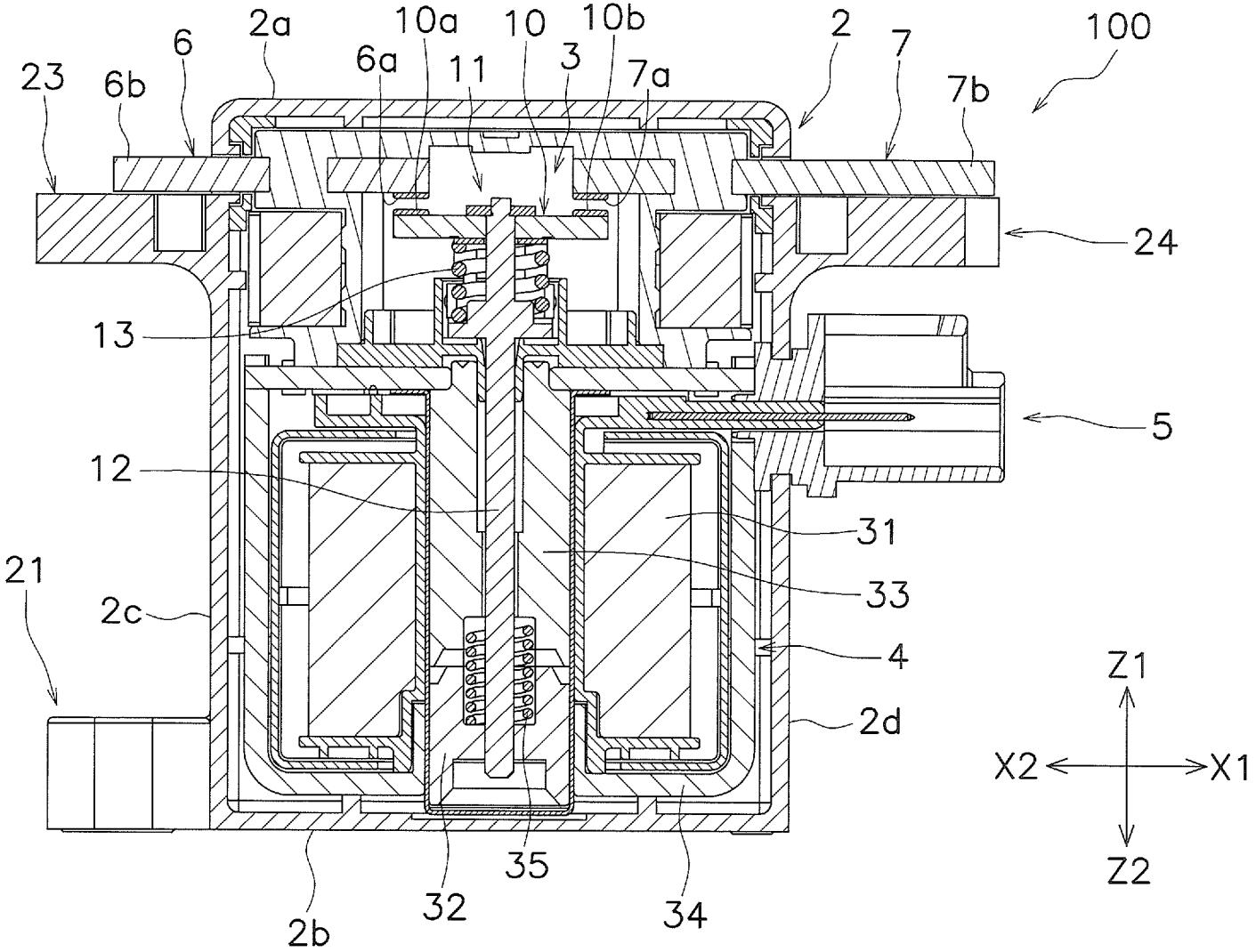
FIG. 3 is a sectional view taken along line III-III of FIG. 2.

Hereinafter, embodiment of a relay 100 according to one aspect of the present invention will be described with reference to the drawings. When referring to the drawings, an upper side in FIG. 3 is referred to as "up (Z1)", a lower side is referred to as "down (Z2)", a left side is referred to as "left (X1)", and a right side is referred to as "right (X2)" in order to facilitate understanding of the description. In addition, a front side of the paper surface of FIG. 3 is referred to as "front (Y1)", and a back side of the paper surface of FIG. 3 is referred to as "back (Y2)". An up-down direction Z is orthogonal to a left-right direction X. A front-back direction Y is orthogonal to the up-down direction Z and the left-right direction X. The up-down direction Z is an example of a first direction. The left-right direction X is an example of a second direction. The front-back direction Y is an example of a third direction.

Further, one side in the left-right direction X will be described as the right side (X1 side), and an opposite side in the left-right direction X will be described as the left side (X2 side). One side in the front-back direction Y will be described as the front side (Y1 side), and an opposite in the front-back direction Y will be described as the back side (Y2 side). These directions are defined for convenience of explanation, and do not limit an arrangement direction of the relay 100.

The relay 100 includes a housing 2, a contact device 3, a drive device 4, and a connector connecting portion 5.

The housing 2 has a substantially rectangular box shape and is made of an insulating material. The contact device 3 and the drive device 4 are housed inside the housing 2.

The housing 2 includes an upper portion 2*a*, a lower portion 2*b*, first to fourth side portions 2*c* to 2*f*, a first mounting portion 21, and a second mounting portion 22.

The upper portion 2*a* and the lower portion 2*b* have a rectangular shape and extend along the left-right direction X and the front-back direction Y. The first side portion 2*c* and the second side portion 2*d* extend along the front-back direction Y and the up-down direction Z, and connect the upper portion 2*a* and the lower portion 2*b*. The first side portion 2*c* is arranged to the left side (X2 side) in the left-right direction X. The second side portion 2*d* is arranged to the right side (X1 side) in the left-right direction X. The second side portion 2*d* is arranged so as to face the first side portion 2*c* in the left-right direction X.

The third side portion 2*e* and the fourth side portion 2*f* extend along the left-right direction X and the up-down direction Z, and connect the upper portion 2*a* and the lower portion 2*b*. The third side portion 2*e* is arranged to the one side (Y1 side) in the front-back direction Y and is connected to the first side portion 2*c* and the second side portion 2*d*. The fourth side portion 2*f* is arranged to the opposite side (Y2 side) in the front-back direction and is connected to the first side portion 2*c* and the second side portion 2*d*. The fourth side portion 2*f* is arranged to face the third side portion 2*e* in the front-back direction Y.

The first mounting portion 21 and the second mounting portion 22 are provided to fix the relay 100 to other members with a fixing member such as a screw. The first mounting portion 21 is provided so as to protrude to the left side from a lower portion of the back side of the first side portion 2*c*. The first mounting portion 21 includes a first through hole 21*a*. The first through hole 21*a* is a hole that penetrates in the up-down direction Z. A collar member, for example, is press-fitted into the first through hole 21*a*, and the first mounting portion 21 is fixed to another member by a fixing member such as a screw inserted into the first through hole 21*a*.

The second mounting portion 22 is arranged with a space in the left-right direction X with respect to the first mounting portion 21. In the present embodiment, the second mounting portion 22 is arranged apart from the first mounting portion 21 in the right side (X1 side). The second mounting portion 22 is disposed closer to the front side (Y1 side) than the first mounting portion 21. In the present embodiment, the second mounting portion 22 is provided so as to protrude to the right side from the lower portion of the front side of the second side portion 2*d*.

The second mounting portion 22 includes a second through hole 22*a*. The second through hole 22*a* is a hole that penetrates in the up-down direction Z. A collar member, for example, is press-fitted into the second through hole 22*a*, and the second mounting portion 22 is fixed to another member by a fixing member such as a screw inserted into the second through hole 22*a*.

The contact device 3 includes a first fixed terminal 6, a second fixed terminal 7, a movable contact piece 10, and movable mechanism 11.

The first fixed terminal 6 and the second fixed terminal 7 are plate-shaped terminals and extend in the left-right direction X. The first fixed terminal 6 and the second fixed terminal 7 extend both inside and outside the housing 2. The first fixed terminal 6 and the second fixed terminal 7 are arranged apart from each other in the left-right direction X. The first fixed terminal 6 and the second fixed terminal 7 are made of a conductive material.

The first fixed terminal 6 includes a first fixed contact 6*a* and a first fastening portion 6*b*. The first fixed contact 6*a* is arranged inside the housing 2. The first fixed contact 6*a* is provided separately from the first fixed terminal 6. The first fixed contact 6*a* may be integrated with the first fixed terminal 6.

The first fastening portion 6*b* is connected to an external terminal (not illustrated) such as a bus bar by screw fastening. The first fastening portion 6*b* protrudes outside the housing 2. The first fastening portion 6*b* is exposed outside the housing 2 closer to the front side (Y1 side) than the first mounting portion 21. The first fastening portion 6*b* in the present embodiment protrudes leftward from near the upper portion of the first side portion 2*c* of the housing 2. As viewed from the up-down direction Z, the first fastening portion 6*b* is arranged apart from the first through hole 21*a* in the front-back direction Y. The first fastening portion 6*b* includes a first screw insertion hole 6*c*. The first screw insertion hole 6*c* is a hole that penetrates in the up-down direction Z.

At a height position of the first fastening portion 6*b* in the up-down direction Z, the first fastening portion 6*b* is arranged without protruding beyond a boundary B1 between the first side portion 2*c* and the third side portion 2*e* to the front side (Y1 side). In the present embodiment, the entire first fastening portion 6*b* is arranged closer to the back side (Y2 side) than the boundary B1 between the first side portion 2*c* and the third side portion 2*e*. The first fastening portion 6*b* is arranged closer to the back side than the third side portion 2*e*. The front end of the first fastening portion 6*b* is positioned closer to the back side than the third side portion 2*e*.

A first screw receiving member 23 provided in the housing 2 is arranged below the first fastening portion 6*b*. The first screw receiving member 23 is arranged below the first fastening portion 6*b* and adjacent to the first fastening portion 6*b*. A female screw member (not illustrated) that is screwed into a fixing member such as a screw is arranged inside the first screw receiving member 23.

The second fixed terminal 7 includes a second fixed contact 7*a* and a second fastening portion 7*b*. The second fixed contact 7*a* is arranged inside the housing 2. The second fixed contact 7*a* is provided separately from the second fixed terminal 7. The second fixed contact 7*a* may be integrated with the second fixed terminal 7.

The second fastening portion 7*b* is connected to an external terminal (not illustrated) such as a bus bar by screw fastening. The second fastening portion 7*b* protrudes outside the housing 2. The second fastening portion 7*b* is exposed outside the housing 2 closer to the back side (Y2 side) than the second mounting portion 22. The second fastening portion 7*b* is disposed closer to the back side (Y2 side) than the first fastening portion 6*b*. The second fastening portion 7*b* in the present embodiment protrudes rightward from the vicinity of the upper portion of the second side portion 2*d* of the housing 2. The second fastening portion 7*b* is exposed outside the housing 2 closer to the back side than the second mounting portion 22 and is disposed closer to the back side than the first fastening portion 6*b*. As viewed from the up-down direction Z, the second fastening portion 7*b* is arranged apart from the second through hole 22*a* in the front back direction Y. The second fastening portion 7*b* includes a second screw insertion hole 7*c*. The second screw insertion hole 7*c* is a hole that penetrates in the up-down direction Z.

At a height portion of the second fastening portion 7*b* in the up-down direction Z, the second fastening portion 7*b* is arranged without protruding beyond a boundary B2 between the second side portion 2*d* and the fourth side portion 2*f* to the back side (Y2 side). In the present embodiment, the entire second fastening portion 7*b* is arranged closer to the front side (Y1 side) than the boundary B2 between the second side portion 2*d* and the fourth side portion 2*f*. The second fastening portion 7*b* is arranged closer to the front side (Y1 side) than the second side portion 2*d*. The back end of the second fastening portion 7*b* is positioned closer to the front side than the fourth side portion 2*f*.

A second screw receiving member 24 provided in the housing 2 is arranged below the second fastening portion 7*b*. The second screw receiving member 24 is arranged below the second fastening portion 7*b* and adjacent to the second fastening portion 7*b*. A female screw member (not illustrated) that is screwed into a fixing member such as a screw is arranged inside the second screw receiving member 24.

Figure 1:
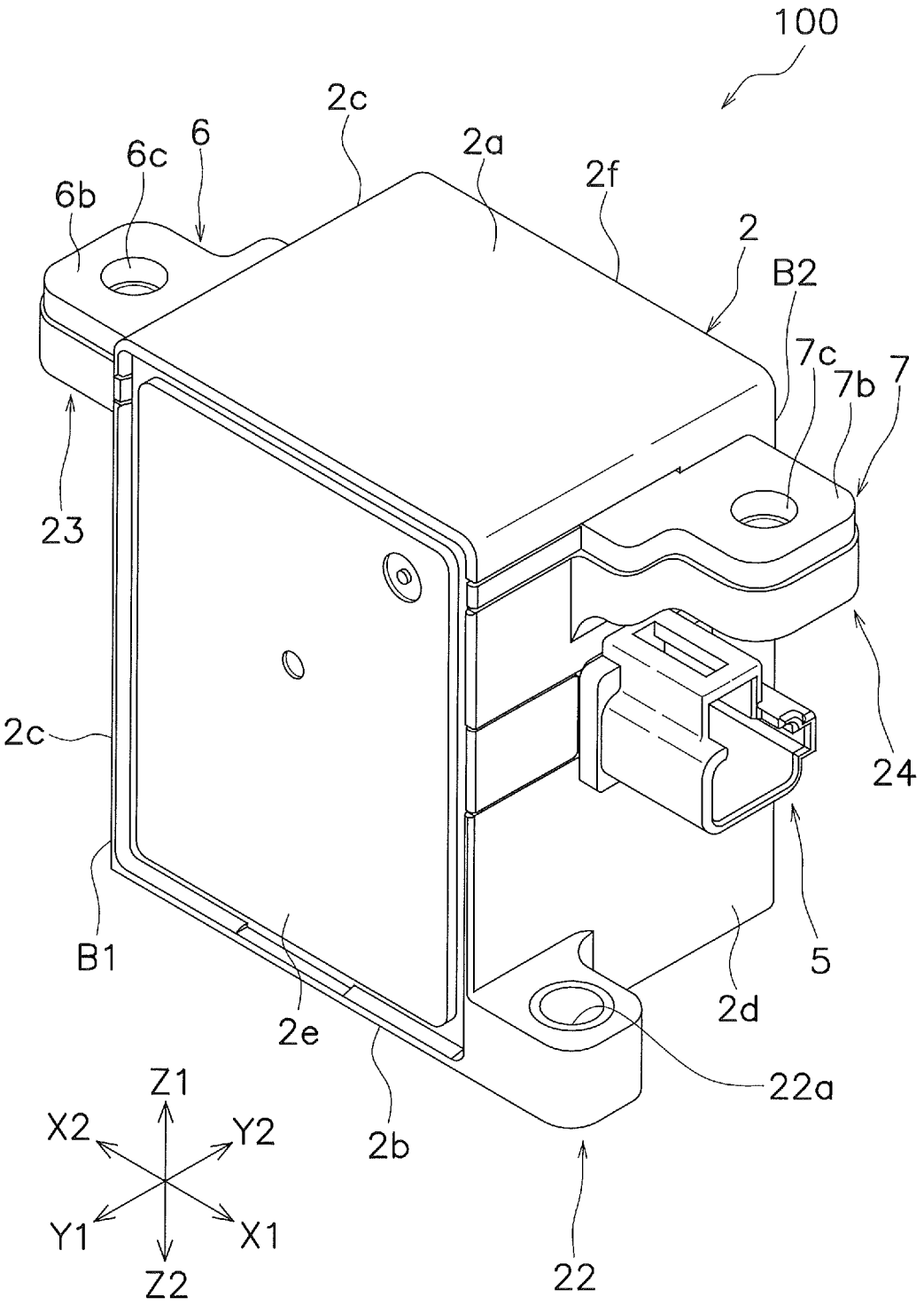
FIG. 1 is a perspective view of a relay.
Figure 2:
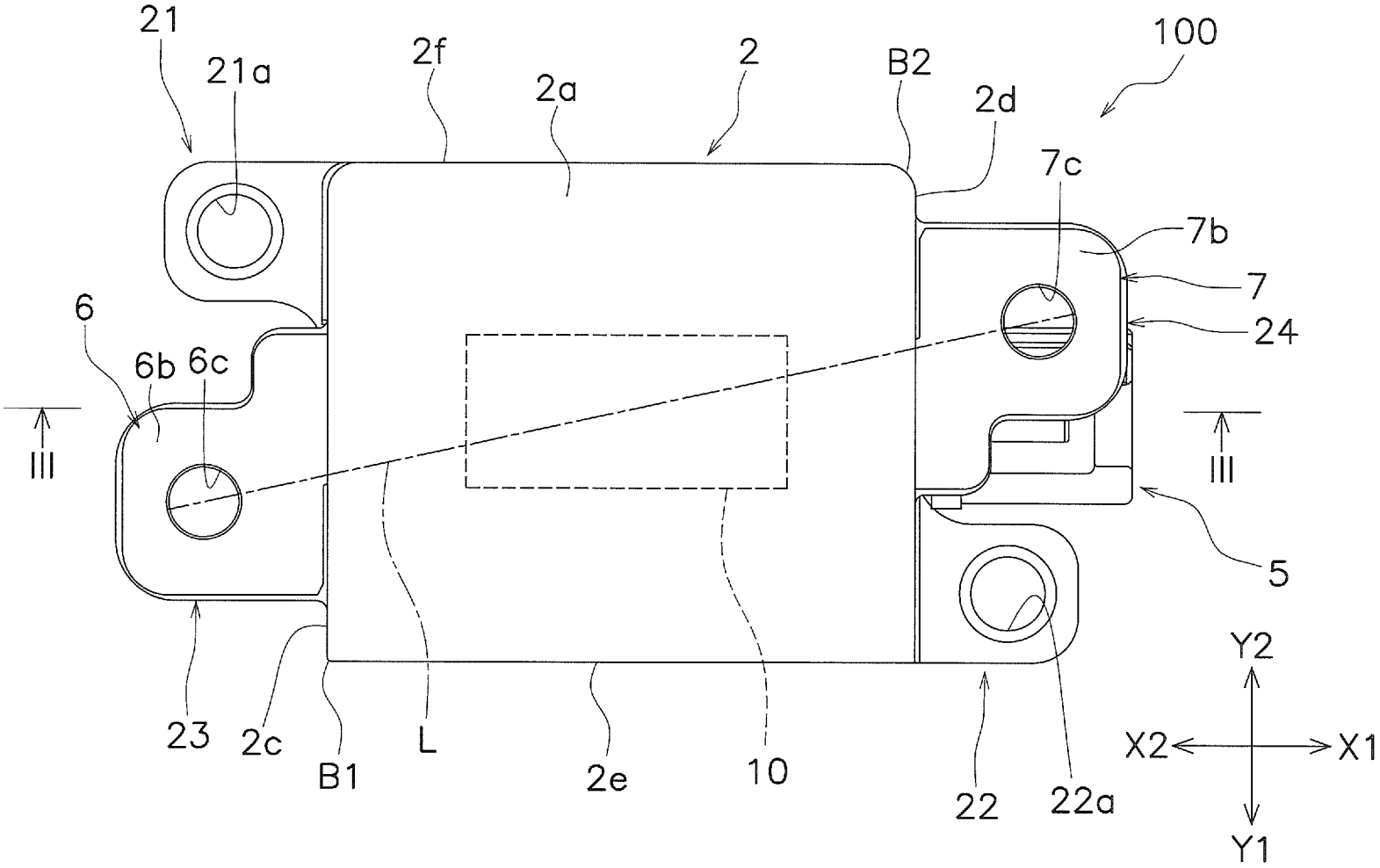
FIG. 2 is a view of the relay as viewed from above.

As illustrated in FIG. 2, a virtual line L connecting the first screw insertion hole 6*c* and the second screw insertion hole 7*c* is inclined with respect to the third side portion 2*e* and the fourth side portion 2*f* as viewed from the up-down direction Z. That is, the virtual line L extends in a direction intersecting with respect to the third side portion 2*e* and the fourth side portion 2*f* as viewed from the up-down direction Z. Further, the virtual line L is inclined with respect to the movable contact piece 10 as viewed from the up-down direction Z.

The movable contact piece 10 is a plate shape member that is long in one direction, and extends in the left-right direction X in the housing 2. The movable contact piece 10 is made of a conductive material. The movable contact piece 10 is movable in a contact direction and a separation direction. The contact direction is a direction (upward in FIG. 3) in which the movable contact piece 10 approaches the first fixed contact 6*a* and the second fixed contact 7*a*. The separation direction is a direction (downward in FIG. 3) in which the movable contact piece 10 separates from the first fixed contact 6*a* and the second fixed contact 7*a*. Therefore, the contact direction and the separation direction are parallel to the up-down direction Z.

The movable contact piece 10 includes a movable contact 10*a* and a movable contact 10*b*. The movable contact 10*a* is arranged at a position facing the first fixed contact 6*a*. The movable contact 10*b* is arranged at a position facing the second fixed contact 7*a*. The movable contacts 10*a*, 10*b* are provided separately from the movable contact piece 10. The movable contacts 10*a*, 10*b* may be integrated with the movable contact piece 10

The movable mechanism 11 includes a drive shaft 12 and a contact spring 13. The drive shaft 12 extends in the up-down direction Z and penetrates the movable contact piece 10 in the up-down direction Z. The drive shaft 12 is provided so as to be movable in the contact direction and the separation direction. The contact spring 13 biases the movable contact piece 10 in the contact direction.

The drive device 4 moves the movable mechanism 11 in the contact direction and the separation direction by an electromagnetic force. The drive device 4 includes a coil 31, a movable iron core 32, a fixed iron core 33, a yoke 34, and a return spring 35.

When a voltage is applied and the coil 31 excited, the coil 31 generates the electromagnetic force that moves the movable iron core 32 in the contact direction. The movable iron core 32 is coupled to the drive shaft 12 so as to be integrally movable. The fixed iron core 33 is arranged at a position facing the movable iron core 32. The yoke 34 is arranged so as to surround the coil 31. The return spring 35 is arranged between the movable iron core 32 and the fixed iron core 33. The return spring 35 biases the movable iron core 32 in the separation direction.

The connector connecting portion 5 is provided to supply driving power to the coil 31, and is connected to the drive device 4. The connector connecting portion 5 is arranged to be exposed from the housing 2 to the right side (X1 side) or the left side (X2 side), and is arranged to be visible from between the first mounting portion 21 and the first fastening portion 6*b* or between the second mounting portion 22 and the second fastening portion 7*b* as viewed from the up-down direction Z. In the present embodiment, the connector connecting portion 5 is arranged to be exposed from housing 2 to the right side (X1 side). The connector connecting portion 5 protrudes outward from the vicinity of the center of the second side portion 2*d* of the housing 2. As illustrated in FIG. 2, the connector connecting portion 5 is visible from between the second mounting portion 22 and the second fastening portion 7*b* as viewed from the up-down direction Z.

In the relay 100 having configured as described above, the second fastening portion 7*b* is disposed closer to the back side (Y2) than the second mounting portion 22 and the first fastening portion 6*b*. That is, the first fastening portion 6*b* and the second fastening portion 7*b* are arranged zigzag in the left-right direction X. Accordingly, even when the first mounting portion 21 is disposed at the front side (Y1 side) and the second mounting portion 22 is disposed at the back side (Y2 side) as compared with the case where the first fastening portion 6*b* and the second fastening portion 7*b* are arranged side by side in the left-right direction X, a tool clearance for fixing the first mounting portion 21 and second mounting portion 22 to another member can be secured. As a result, the housing 2 can be downsized in the front-back direction Y Further, even when widths of the first fixed terminal 6 and the second fixed terminal 7 are expanded in the front-back direction Y in order to improve a current carrying capacity of the relay 100, the housing 2 can be downsized in the front-back direction while ensuring the tool clearance.

Further, since the first fastening portion 6*b* is disposed closer to the back side (Y2 side) than the third side portion 2*e*, for example, a space around the boundary B1 can be effectively utilized as compared with the case where the first fastening portion 6*b* protrudes to the front side (Y1 side) more than the third side portion 2*e*. Similarly, since the second fastening portion 7*b* is disposed closer to the front side (Y1 side) than the fourth side portion 2*f*, a space around the boundary B2 can be effectively utilized.

While the embodiment of the electromagnetic relay according to one aspect of the present invention has been described, the present invention should not be construed as being limited thereto, and various types of modifications may be made without departing from the spirit or scope of the general inventive concept of the invention.

Figure 4:
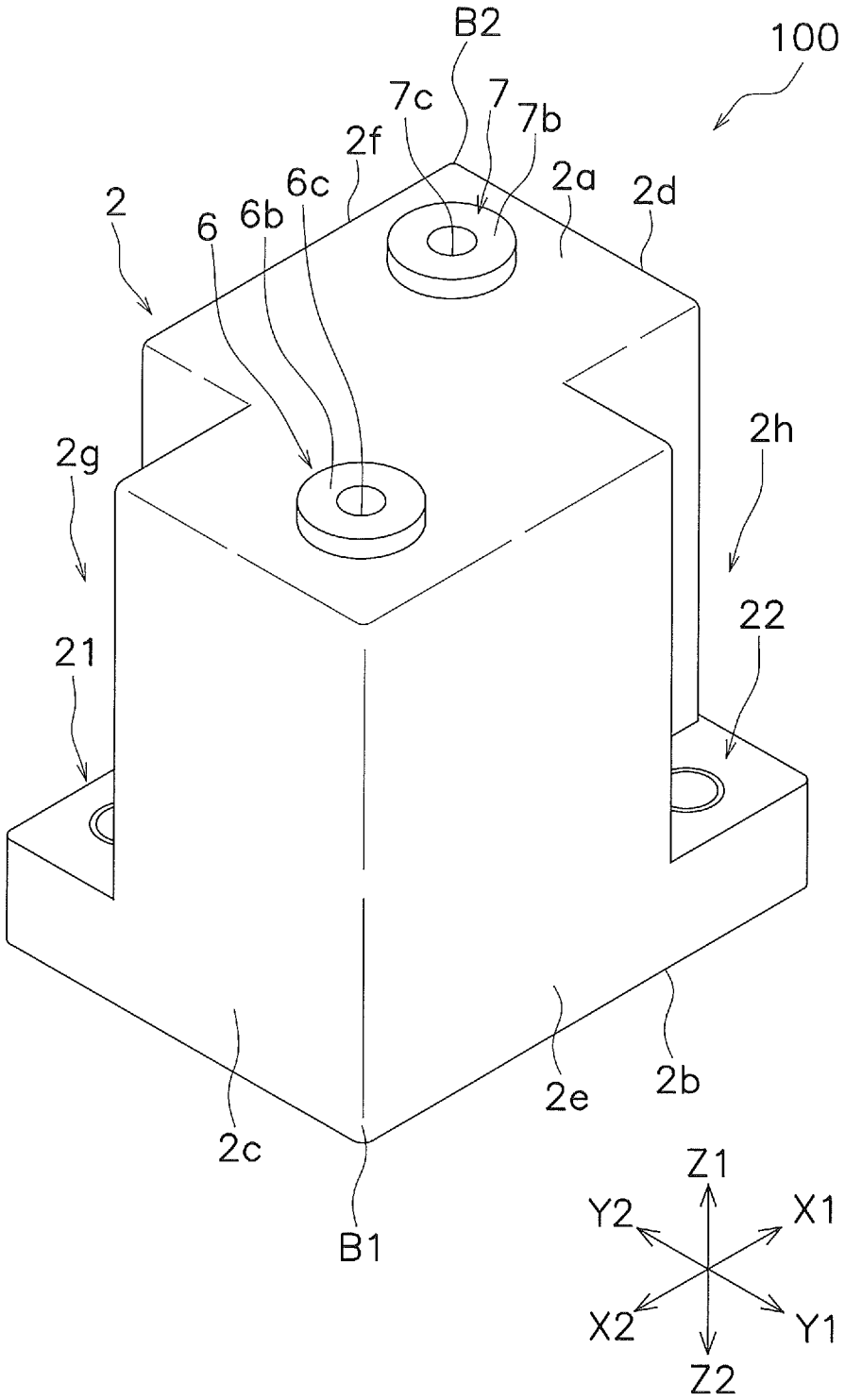
FIG. 4 is a perspective view of the relay according to a modification.
Figure 5:
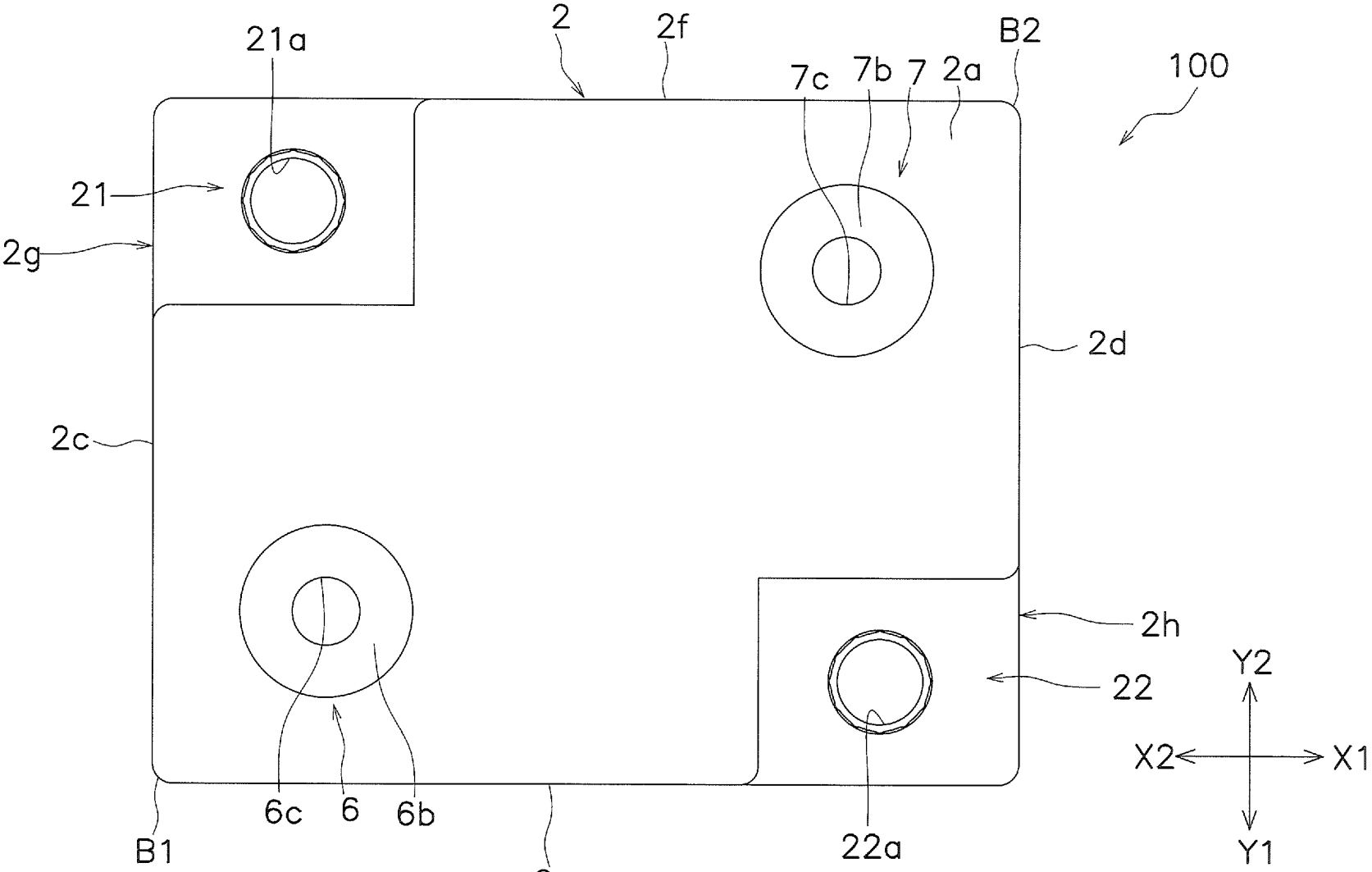
FIG. 5 is a perspective view of the relay according to the modification as viewed from above.

In the above-described embodiment, the first fixed terminal 6 and the second fixed terminal 7 are configured by plate-shaped terminals, but as illustrated in FIGS. 4 and 5, for example, the first fixed terminal 6 and the second fixed terminal 7 may be configured by cylindrical terminals. The first fixed terminal 6 and the second fixed terminal 7 protrude to outside from the upper portion 2*a* of the housing 2. As viewed from the up-down direction Z, at least a part of the first mounting portion 21 may overlap the first fixed terminal 6 in the front-back direction Y and the second fixed terminal 7 in the left-right direction X. As viewed from the up-down direction Z, at least a part of the second mounting portion 22 may overlap the first fixed terminal 6 in the left-right direction X and the second fixed terminal in the front-back direction Y. The first mounting portion 21 may be provided in a bottom of a recess 2*g* formed by recessing from the upper portion 2*a* toward the lower portion 2*b* near the boundary between the first side portion 2*c* and the fourth side portion 2*f*. Similarly, the second mounting portion 22 may be provided in a bottom of a recess 2*h* by formed by recessing from the upper portion 2*a* toward the lower portion 2*b* near the boundary between the second side portion 2*d* and the third side portion 2*e*.

In the above-described embodiment, the first side portion 2*c* and the second side portion 2*d* are extended along the front-back direction Y and the up-down direction Z, and the third side portion 2*e* and the fourth side portion 2*f* are extended along the left-right direction X and the up-down direction Z. However, shapes of the first to fourth side portions 2*c* to 2*f* are not limited to those in the above embodiment. The first to fourth side portions 2*c* to 2*f* may be curved in an arc shape or may be inclined in a predetermined direction.

The connector connecting portion 5 is not limited to the above embodiment. The drive device 4 and the connector connecting portion 5 may be connected via a harness. Further, the arrangement of the connector connecting portion 5 is not limited to the above embodiment.

Figure 6:
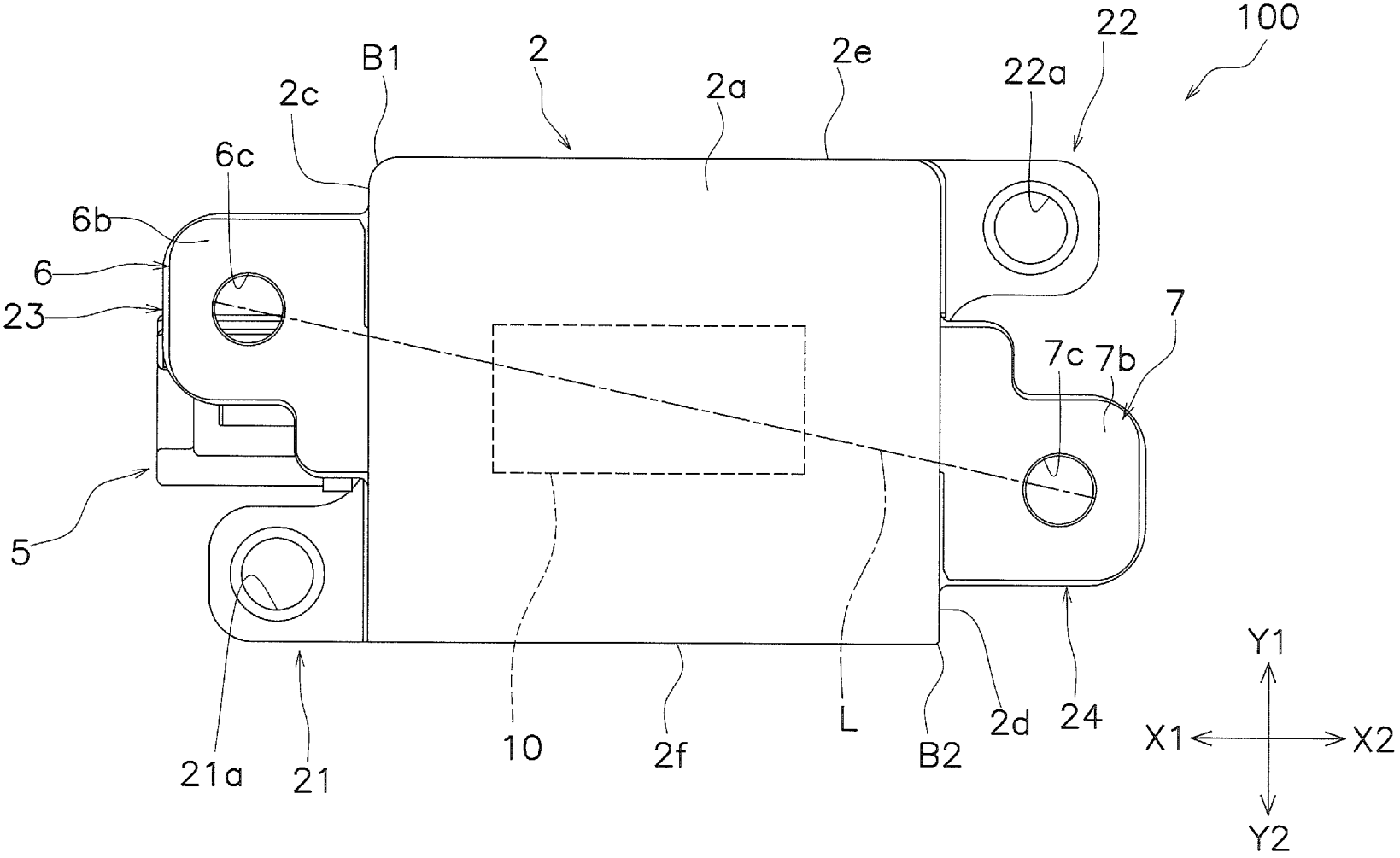
FIG. 6 is a view of a relay according to another embodiment as viewed from above.

In the above-described embodiment, the one side in the front-back direction is described as the front side (Y1 side), the opposite side is the back side (Y2 side), the one side in the left-right direction X is the right side (X2 side), and the opposite side is the left side (X1 side). However, the one side in the front-back direction Y may be the back side (Y1 side), the opposite side may be the front side (Y2 side), the one side in the left-right direction X may be the left side (X2 side), and the opposite side may be the right side (X1 side). In this case, as illustrated in FIG. 6, the relay 100 has a configuration in which the configuration of the relay 100 illustrated in FIG. 2 is reversed in the front-back direction Y and the left-right direction X.

The invention claimed is:

1. A relay comprising:

a housing including a first mounting portion having a first through hole penetrating in a first direction and a second mounting portion having a second through hole penetrating in the first direction, the second mounting portion being disposed separately from the first mounting portion to one side in a second direction orthogonal to the first direction and disposed closer to one side in a third direction than the first mounting portion, the third direction being orthogonal to the first direction and the second direction;

a first fixed terminal including a first fastening portion, the first fastening portion having a first screw insertion hole along the first direction and being exposed outside the housing closer to the one side in the third direction than the first mounting portion; and a second fixed terminal including a second fastening portion, the second fastening portion having a second screw insertion hole along the first direction, being exposed outside the housing closer to an opposite side in the third direction than the second mounting portion, and being disposed closer to the opposite side in the third direction than the first fastening portion, wherein the housing includes a first side portion disposed at an opposite side in the second direction, a second side portion disposed at the one side in the second direction, a third side portion connected to the first side portion and the second side portion at the one side in the third direction, and a fourth side portion connected to the first side portion and the second side portion at the opposite side in the third direction, the first fastening portion is arranged without protruding beyond a boundary between the first side portion and the third side portion to the one side in the third direction at a height position of the first fastening portion in the first direction, and the second fastening portion is arranged without protruding beyond a boundary between the second side portion and the fourth side portion to the opposite side in the third direction at a height position of the second fastening portion in the first direction.

2. The relay according to claim 1, wherein the first fastening portion is disposed closer to the opposite side in the third direction than the third side portion, and the second fastening portion is disposed closer to the one side in the third direction than the fourth side portion.

3. The relay according to claim 1, wherein the first fixed terminal and the second fixed terminal are plate-shaped terminals, the first fastening portion protrudes from the first side portion, and the second fastening portion protrudes from the second side portion.

4. The relay according to claim 1, wherein a virtual line connecting the first screw insertion hole and the second screw insertion hole is inclined with respect to the third side portion and the fourth side portion as viewed from the first direction.

5. The relay according to claim 1, further comprising:

a movable contact piece extending in the housing in the second direction and configured to contact the first fixed terminal and the second fixed terminal, wherein a virtual line connecting the first screw insertion hole and the second screw insertion hole is inclined with respect to the movable contact piece as viewed from the first direction.

6. The relay according to claim 1, further comprising:

a connector connecting portion that is arranged to be exposed from the housing to the one side in the second direction and that is visible from between the second mounting portion and the second fastening portion as viewed from the first direction.

7. The relay according to claim 1, further comprising:

a connector connecting portion is arranged to be exposed from the housing to the opposite side in the second direction and is visible from between the first mounting portion and the first fastening portion as viewed from the first direction.

* * * * *